United States Patent [19]

Nagatsuka et al.

[11] Patent Number: 4,912,004

[45] Date of Patent: Mar. 27, 1990

[54] CARRIER FOR DEVELOPER

[75] Inventors: Ikutaroh Nagatsuka; Yasuo Matsumura; Masayuki Takeda; Emi Takahashi; Takayoshi Aoki, all of Kanagawa, Japan

[73] Assignee: Fuji Xerox Co., Ltd., Tokyo, Japan

[21] Appl. No.: 223,819

[22] Filed: Jul. 15, 1988

[30] Foreign Application Priority Data

Jul. 16, 1987 [JP] Japan ..... 62-176041

[51] Int. Cl.[4] ..... G03G 9/10

[52] U.S. Cl. ..... 430/106.6; 430/108

[58] Field of Search ..... 430/108, 99, 109, 106.6

[56] References Cited

U.S. PATENT DOCUMENTS 4,572,885 2/1986 Sato et al. ..... 430/108

4,639,403 1/1987 Podszun et al. ..... 430/115

4,791,041 12/1988 Aoki et al. ..... 430/108

FOREIGN PATENT DOCUMENTS 54-68246 6/1979 Japan .

58-59457 4/1983 Japan .

*Primary Examiner*—John L. Goodrow

*Attorney, Agent, or Firm*—Finnegan, Henderson, Farabow, Garrett and Dunner

[57] ABSTRACT

A carrier for a developer is disclosed, comprising a carrier core containing a binder resin and a magnetic powder as essential components, and a coating layer provided on the surface of the carrier core, the coating layer containing a polymer obtained by polymerizing a charge controlling monomer in the presence of polyolefin.

16 Claims, 1 Drawing Sheet

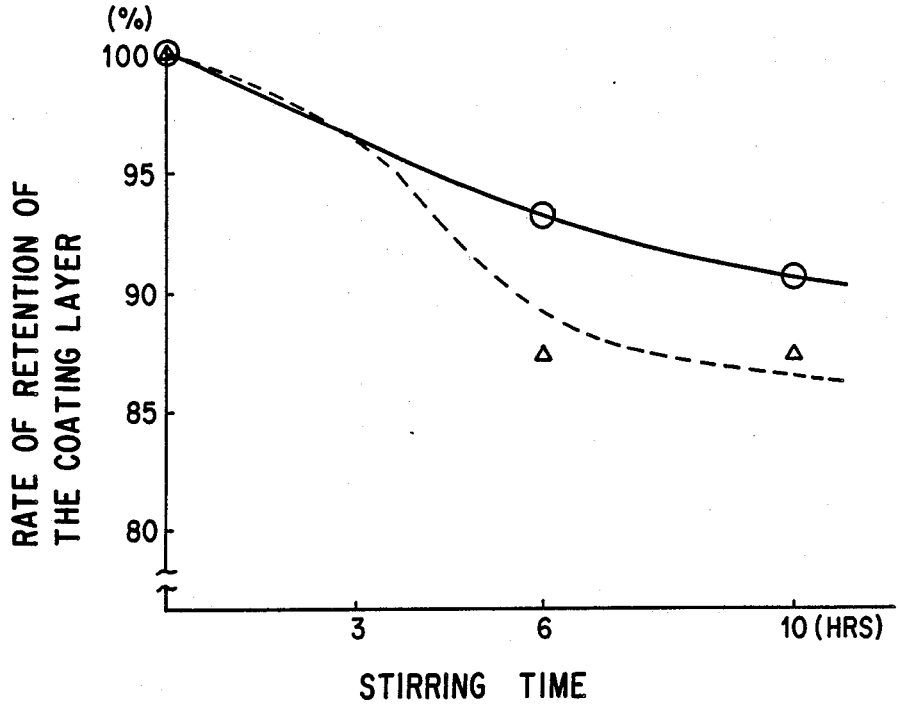
(%)
100
95
90
85
80
RATE OF RETENTION OF THE COATING LAYER
3
6
10 (HRS)
STIRRING TIME

CARRIER FOR DEVELOPER

FIELD OF THE INVENTION

The present invention relates to a carrier as a component of a two-component type developer to be used in development of electrostatic or magnetic latent images in the electrophotography, electrostatic recording, electrostatic printing and the like, and more particularly to a spherical carrier having a magnetic substance dispersed therein.

BACKGROUND OF THE INVENTION

As described in Japanese Patent Application (OPI) No. 68246/79, a dispersion type carrier comprising a magnetic substance dispersed in a resin is shown to be excellent in reproductivity of solid images and line images when used as a carrier for a two-component type developer to be used in development of an electrostatic latent image.

It is also known that a coating layer can be provided on the above dispersion type carrier and an electron charge-controlling agent is added to the coating layer to control charging (see, for example, Japanese Patent Application (OPI) No. 59457/83).

The term "OPI" as used herein means an "unexamined published patent application".

However, such dispersion type carrier with a coating layer provided thereon has a number of problems. First since the shape of a core- material is not definite, a uniform coating layer is difficult to form. Also, a solvent-soluble polymer cannot be used as the binder for the core. Further, the surface of the carrier is worn by use over a long period of time and the coating layer is peeled apart, which increases the changes in the amount of electric charge on the carrier surface.

Another problem is that a toner attaches to the carrier surface (toner impaction), which causes a reduction in the amount of electric charge on the carrier after long periods of use. In order to prevent this toner impaction, it has been proposed to use polyolefin having a low surface energy as a coating layer on the carrier surface, as described in U.S. patent application Ser. No. 148,345 filed Jan. 25, 1988. However, when polyolefin with an electric charge controlling agent added thereto is used as a coating layer, the electric charge controlling agent is not uniformly dispersed in the polyolefin. Consequently, when the carrier is used for a long time, the electric charge controlling agent tends to drop from the carrier. In order to overcome the latter problem, it has been proposed to prevent the dropping from the carrier surface by using an electric charge controlling polymer.

However, polyolefin has poor compatibility with other electric charge controlling polymers. Therefore, when it is incorporated in the coating layer in the form of a mixture with electric charge controlling polymers, phase separation occurs in the coating layer and there is formed a coating layer in which the polyolefin and the electric charge controlling agent are not uniformly dispersed. Therefore, there is a problem in that a large variation occurs in the amount of electric charge on the carrier surface.

SUMMARY OF THE INVENTION

An object of the present invention is to provide a carrier which enables improved control of the amount and polarity of electric charge on the carrier and which is free from a variation in the amount of electric charged built up on the carrier after a long time use.

Another object of the present invention is to provide a carrier in which the polarity of electric charge can be changed only by changing the coating layer while maintaining the quality of the carrier core.

In accordance with the present invention, the above objects are attained by using a carrier in which the surface of a carrier core comprising a binder resin and a magnetic powder dispersed therein is coated with a coating layer of a polymer obtained by polymerizing a charge controlling monomer in the presence of a polyolefin.

Thus, the present invention provides a carrier for a two-component type developer, comprising a carrier core containing a binder resin and a dispersed magnetic powder as essential components and a coating layer on the surface of the carrier core, the coating layer containing a polymer of a charge controlling monomer having a polyolefin uniformly dispersed therein.

BRIEF DESCRIPTION OF THE DRAWING

The FIGURE is a graph showing the peeling state of the coating layer in the carriers of Example 3 and Comparative Example 3, wherein the abscissa indicates a stirring time and ordinates indicates the rate of retention of the coating layer.

DETAILED DESCRIPTION OF THE INVENTION

Preferred embodiments of the carrier of the present invention will hereinafter be described, together with the method of making the carrier. First, the carrier core and the making of the same is described, followed by a description of the coating layer and the forming of such layer on the carrier core.

As the binder resin in the carrier core, a thermoplastic resin can be used. Particularly suitable such resins are: homopolymers or copolymers of styrenes such as styrene, chlorostyrene, and vinylstyrene; monoolefins such as ethylene, propylene, butylene, and isobutylene; vinyl esters, such as vinyl acetate, vinyl propionate, vinyl benzoate, and vinyl butyrate; esters of $\alpha$-methylene aliphatic monocarboxylic acids, such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones, such as vinyl methyl ketone, vinyl hexyl ketone, and vinyl isopropenyl ketone. Particularly typical binder resins are polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polybutylene, and polyisobutylene. In addition, polyester, polyurethane, epoxy resin, silicone resin, polyamide, modified rosin, paraffin, waxes and the like can be used.

Of these binder resins, a polyolefin homopolymer or copolymer is preferably used. The reason for this is that, if the carrier core contains polyolefin, the affinity of the polymer of the coating layer to the polyolefin is good, and, thus, the coating layer is peeled from the carrier core only with difficulty.

As the magnetic powder to be used in the carrier core, any of fine particles of known ferromagnetic substances can be used, particle size of which is generally from 0.01 to 5 μm and preferably from about 0.05 to 1 μm. Specific examples are triiron tetraoxide, γ-diiron trioxide, various ferrite powders, chromium oxide, various metal powders and similar magnetic substances.

In addition to the binder resin and the magnetic powder, other core components such as another resin, a charge controlling agent, a coupling agent, a filler and other fine powders can be incorporated in the carrier core for the purpose of controlling charging, increasing dispersion, reinforcing strength and of increasing fluidity, if necessary.

The carrier core can be produced by various methods. For example, it can be produced by a method in which a binder resin, a magnetic powder and other core components are uniformly dispersed in the binder resin by kneading with the use of a heating, melting and mixing apparatus such as a kneader, a Banbury mixer and the like, and then ground and sieved; a method in which a kneaded material is solidified by spray cooling; or a method in which a binder resin solution with a magnetic powder dispersed therein is spray dried.

Particularly preferred is the method in which a kneaded material of a binder resin and a magnetic powder is solidified by spray cooling. The reason for this is that the carrier core produced by this method is spherical and has a smooth surface, and it is easy to provide a coating layer having a uniform film thickness. Therefore, a thin coating layer can be easily provided which can be peeled from the carrier core only with difficulty, charging properties of long use are stabilized, and the service life is increased.

In the present invention, the average particle diameter of the carrier core is controlled, and preferably is in the range of from 15 to 200 μm, and more preferably in the range of from 35 to 150 μm.

The coating layer formed on the surface of the above carrier core contains a polymer obtained by polymerizing a charge controlling monomer in the presence of polyolefin.

This polymer can be obtained by adding a charge controlling monomer and a polymerization initiator to a solvent with polyolefin dissolved therein, and polymerizing the monomer. The weight ratio of the charge controlling monomer to the polyolefin is generally from 1/9 to 9/1, and the polymerization initiator is generally added in an equimolar amount or more based on the amount of the charge controlling monomer. Examples of the solvent include those capable of swelling polyolefin, such as toluene, xylene, methyl isobutyl ketone, and chlorobenzene, with toluene and xylene being particularly preferred. The resulting polymer is a polymer in which polyolefin is partially grafted to (1) an addition polymer of the charge controlling monomer, or (2) a block copolymer comprising a polyolefin portion and a portion which is a polymer of the charge controlling monomer, or (3) a polymer blend of polyolefin and a charge controlling polymer. In addition, a polymer obtained by polymerizing a charge controlling monomer in the presence of polyolefin and at least one other polymer can be used.

In accordance with the above method, polyolefin is uniformly dispersed in the polymer, and a polymer in which polyolefin is partially bonded to the charge controlling polymer is obtained. Therefore, the surface energy of the polymer itself is low and the polymer has uniform charging characteristics. Even in a resin having poor compatibility with polyolefin, a polymer in which polyolefin is uniformly dispersed in the polymer is obtained by dispersing the polyolefin at the monomer stage. Phase-separation is prevented by chemical bonding, a polymer having uniform quality is obtained and there is less change with time.

As the polyolefin to be used in the production of the above polymer, any suitable polyolefin, such as polyethylene, polypropylene, polybutylene, polyisobutylene or the like can be used. The polyolefin preferably has a weight average molecular weight ($\overline{M}w$) of not more than 20,000. Of these, polyethylene having $\overline{M}w$ of not more than 6,000 and polypropylene having $\overline{M}w$ of not more than 15,000 are particularly preferred.

As the charge controlling monomer, any monomer which when polymerized permits charging of the toner due to friction can be used. For example, combinations of well known radical polymerizable monomers having a polar group in the monomer thereof and radical copolymerizable monomers can be used. Particularly suitable such monomers are styrenes, such as styrene, chlorostyrene, and vinylstyrene; vinyl esters, such as vinyl acetate, vinyl propionate, vinyl benzoate, and vinyl butyrate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketone such as vinyl methyl ketone, vinyl hexyl ketone, and vinyl isopropenyl ketone. Compounds having fluorine in the side chain thereof are also suitable for use. Typical examples are fluorinated alkyl acrylate and fluorinated alkyl methacrylate. These can be used alone or in combination with other monomers.

Typical examples of the polymer which is formed when the above charge controlling monomer is polymerized in the presence of polyolefin are polystyrene, polyalkyl methacrylate, a styrene-alkyl acrylate copolymer, a styrene-alkyl methacrylate copolymer, a styrene-acrylonitrile copolymer, a styrene-butadiene copolymer, a styrene-maleic anhydride copolymer and the like. In addition, halogen-containing polymers may be formed. Specific examples are chlorinated polyolefin and polymers containing fluorine in the main chain thereof, such as homopolymers of tetrafluoroethylene, trifluoroethylene, vinylidene fluoride, monofluoroethylene, propylene hexafluoride and the like, and copolymers of the above monomers and other copolymerizable monomers such as ethylene, propylene, butylene, vinyl chloride, vinylidene chloride, trichloroethylene and the like.

In the present invention, the polymer obtained by polymerizing the above charge controlling monomer in the presence of polyolefin can be used alone, or, if desired, in combination with less than 70% by weight, preferably less than 50% by weight, of other resins, such as homopolymers or copolymers of the aforesaid charge controlling monomers, if desired for the coating layer.

A coupling agent, a filler and other fine powders can be added for the purpose of, e.g., reinforcing the strength, or increasing the fluidity.

In making the carrier of the present invention, the coating layer can be formed, for example, by the following method. The above coating layer polymer obtained by the above polymerization in the presence of polyolefin, or a mixture of such polymer and another resin is dispersed or dissolved in a solvent (which does not dissolve the binder resin in the carrier core) to prepare a heterogeneous solution. This solution is then coated on the surface of the carrier core, and then the solvent is removed. A fluid bed, a spray drier, a kneader coater and other such apparatus can be used for applying the coating.

In forming the coating layer of the carrier, a poor solvent for polyolefin can be used to form a uniform dispersion of the polymer obtained by polymerizing a charge controlling monomer in the presence of the polyolefin if the solvent dissolves the polymers formed with the polyolefin. In such instance a coating layer with the polyolefin portion uniformly dispersed therein can be formed easily and is resistant to peeling.

In the carrier of the present invention, the thickness of the coating layer is preferably 0.01 to 5 μm and more preferably 0.1 to 1.0 μm.

The thus obtained carrier of the present invention is mixed with a toner and the mixture used as a magnetic brush developer for development of electrostatic latent images.

The toner to be used is not critical. Any toners comprising a binder resin and a colorant dispersed therein, and as used in the usual electrophotographic method can be used.

The carrier of the present invention can be used in all types of magnetic brush developing machines. In addition, since the polarity of charging can be changed by changing the coating layer, the charging polarity and the amount of charge can be controlled in every developing machine by using the same carrier core.

The carrier of the present invention in which a coating layer containing a polymer obtained by polymerizing a charge controlling monomer in the presence of polyolefin is provided on the surface of a carrier core containing a binder resin and a magnetic powder as essential components has the following advantages.

Since the resin in the coating layer has in itself a charge controlling capability, a change in the amount of electric charge due to abrasion is small even after a long term use.

Since the polyolefin portion is uniformly dispersed in the coating layer, the surface energy is small and the toner impaction does not readily occur.

Since the polymer portion having a charge controlling capability and the polyolefin portion are uniformly mixed, the amount of electric charge on the surface of the carrier is uniform and an image which is free from fog can be obtained.

Since the polyolefin is electrically neutral, by controlling the type or amount of the charge controlling monomer, the charging polarity or amount of electric charge of the carrier can be controlled without changing the material constituting the carrier core.

The coating layer of the carrier has good adhesion properties to the carrier core and, thus, exhibits high resistance against peeling.

The present invention is described in greater detail with reference to the following examples, although it is not intended to be limited thereto. In the examples, all parts are by weight.

EXAMPLE 1

| | |
|---|---|
| Magnetic fine particle (EPT-1000, produced by Toda Kogyo Co., Ltd.) | 75 parts |
| Polyethylene (Mitsui Hiwax 400 p, produced by | 25 parts |

-continued

| |
|---|
| Mitsui Petrochemical Co., Ltd.) |

The above ingredients were heated, melted and kneaded by the use of a pressure kneader. After sufficiently kneading, they were solidified by cooling by the use of a disc type spraying apparatus and then sieved to obtain a spherical magnetic particle dispersion type carrier core having an average particle diameter of 80 μm.

100 parts of the carrier core was coated with a 5% chloroform solution of 2 parts of a methyl methacrylate addition polymer obtained by polymerization in the presence of polyethylene (Mitsui Hiwax 400 p/methyl methacrylate, in a ratio of 30/70, by weight) by the use of a flow bed coating apparatus to obtain a coating type spherical carrier of the present invention.

EXAMPLE 2

100 parts of the same carrier core as in Example 1 was coated with a 5% solution of 0.5 part of a perfluorohexylethyl acrylate addition polymer obtained by polymerization in the presence of polyethylene (Mitsui Hiwax 400 p/the acrylate, in a ratio of 20/80, by weight) in a fluorinebased solvent (Daifuron Solvent S-3, produced ,by Daikin Kogyo Co., Ltd.) by the use of a kneader coater to obtain a coating type spherical carrier of the present invention.

The carriers obtained in Examples 1 and 2, and the same carrier core as in Example 1 without application of coating treatment were evaluated in the following manner.

The carrier of Example 1 was mixed with a toner comprising a negatively chargeable styrene-n-butyl methacrylate copolymer and carbon black and having an average particle diameter of 11 μm to obtain a developer (toner concentration 5% by weight). For comparison, the carrier core without the coating layer was also mixed with the negatively chargeable toner to prepare a developer (Comparative Example 1).

Each developer was deposited on a sleeve of a two-component type developing machine and then placed in a face to face relation to a Se light-sensitive material. Copying was performed by the use of a bench machine for evaluation at a light-sensitive material speed of 200 mm/sec and a developing magnetic roll (sleeve) speed of 500 mm/sec for evaluation of the charged amount of the toner, the solid image density, the background contamination, the fine line reproductivity at the initial stage and also the charged amount of the toner, the solid image density, the background contamination, the fine line reproductivity at the time of running 20,000 sheets.

On the other hand, the carrier of Example 2 was mixed with a toner comprising a positively chargeable styrene/n-butyl methacrylate/polyester/polypropylene graft copolymer and carbon black and having an average particle diameter of 11 μm to obtain a developer (toner concentration 5% by weight). For comparison, the carrier core without the coating layer was used with the above toner to prepare a developer (Comparative Example 2).

Each developer was then placed in a face to face relation to a negatively chargeable organic light-sensitive material, and evaluated for the charged amount of the toner, the solid image density, the background contamination, the fine line reproductivity at the initial stage and after running 20,000 sheets using a bench machine for evaluation at a light-sensitive material speed of 350 mm/sec and a developing magnetic roll (sleeve) speed of 550 mm/sec.

The results are shown in the table below. As can be seen from the results, the carrier of the present invention exhibits excellent developing characteristics.

| | Example | | Comparative Example | |
|---|---|---|---|---|
| | 1 | 2 | 1 | 2 |
| Initial Stage: | | | | |
| Charged amount (μc/g) | −18 | 17 | −5 | 10 |
| Solid density | 1.30 | 1.35 | 1.18 | 1.25 |
| Background contamination | 0.00 | 0.00 | 0.08 | 0.03 |
| Fine line reproductivity | Good | Good | Bad | Good |
| 20,000 Sheet Running: | | | | |
| Charged amount (μc/g) | −17 | 15 | −3 | 5 |
| Solid density | 1.35 | 1.30 | 0.90 | 1.08 |
| Background contamination | 0.02 | 0.03 | 0.18 | 0.10 |
| Fine line reproductivity | Good | Good | Bad | Good |
| Service life | more than 20,000 | more than 20,000 | 0 | about 10,000 |
| Judgment | Good | Good | Very Bad | Not good but practical |

EXAMPLE 3

| | |
|---|---|
| Magnetic fine particle (ferrite powder, particle diameter 5 to 6 μm) | 70 parts |
| Polyethylene (Mitsui Hiwax 400p, produced by Mitsui Polychemical Co., Ltd.) | 30 parts |

The above ingredients were heated, melted and kneaded with an attritor. After sufficiently kneading, they were solidified by cooling by the use of a disc type spraying apparatus and then sieved to obtain a spherical magnetic particle dispersion type carrier core having an average particle diameter of 100 μm.

100 parts of the carrier core was coated with a 5% chloroform solution of 2 parts of a methyl methacrylate addition polymer obtained by polymerizing in the presence of polyethylene (Mitsui Hiwax 400 p/methyl methacrylate in a ratio of 30/70, by weight) to obtain a coating type spherical carrier of the present invention.

COMPARATIVE EXAMPLE 3

100 parts of the same carrier core as in Example 3 was coated with a 5% chloroform solution of 2 parts of polymethyl methacrylate by the use of a kneader coater to obtain a coating type spherical magnetic particle dispersion carrier.

For the carriers obtained in Example 3 and Comparative Example 3, the peeling test of the coating layer was performed to measure its retention ratio. That is, 10 g of the carrier was weighed and attached to a magnet roll of a small-sized developing machine, and then stirred in the machine. In this manner, the state of peeling of the coating layer was examined. The coating layer before stirring was dissolved in chloroform and a decrease in the weight was measured.

After stirring for 6 hours and 10 hours, the coating layer was dissolved in chloroform and a decrease in the weight was measured. The retention ratio of the coating layer was calculated from the following equation.

$$\text{Coating Layer Retention Ratio} = \frac{\text{Amount of Coating Layer after Stirring}}{\text{Amount of Coating Layer before Stirring}} \times 100\ (\%)$$

The results are shown in the FIGURE. The retention ratio after 10 hour stirring was 90.9% in Example 3 and 87.9% in Comparative Example 3. From the FIGURE, it is apparent that the carrier of the present invention is small in the peeling of the coating layer.

Having described preferred embodiment of the present invention, it is to be understood that variations and modifications thereof falling within the spirit of the invention will become apparent to those skilled in the art, the scope of the present invention is to be determined by the appended claims and their equivalents.

What is claimed is:

1. A carrier for a developer, comprising particles of a carrier core comprising a binder resin and a dispersed magnetic powder, and a coating layer on the surface of the carrier core particles, said coating layer comprising a polymer obtained by polymerizing a charge controlling monomer in the presence of polyolefin.

2. The carrier of claim 1, wherein said monomer is a radical polymerizable monomer having a polar group in the monomer.

3. The carrier of claim 1, wherein said monomer is a member selected from the group consisting of styrenes, vinyl ethers, α-methylene aliphitic monocarboxylic acid esters, vinyl ethers, vinyl ketones, and compounds having fluorine in the side chains thereof.

4. The carrier of claim 1, wherein said polyolefin is a member selected from the group consisting of polyethylene, polypropylene, polybutene, and polyisobutylene.

5. The carrier of claim 1, wherein said coating layer comprises a mixture of said polymer and another resin.

6. The carrier of claim 1, wherein said coating layer has a thickness of from 0.01 to 5 μm.

7. The carrier of claim 6, wherein said thickness is between 0.1 and 1 μm.

8. The carrier of claim 1, wherein said binder resin is a thermoplastic resin.

9. The carrier of claim 1, wherein said binder resin is a homopolymer or copolymer of a member selected from the group consisting of styrenes, monoolefins, vinyl esters, esters of α-methylene aliphatic monocarboxylic acids, vinyl ethers and vinyl ketones.

10. The carrier of claim 9, wherein said binder resin is a polyolefin.

11. The carrier of claim 1, wherein said binder resin is polyethylene, said charge controlling monomer is methyl methacrylate and said polyolefin is polyethylene.

12. The carrier of claim 1, wherein said binder resin is polyethylene, said charge controlling monomer is prefluorohexylethyl acrylate and said polyolefin is polyethylene.

13. A carrier for a developer, comprising particles of a carrier core comprising a binder resin and a dispersed magnetic powder, and a coating layer on the surface of the carrier core particles, said coating layer comprising a polymer of a charge controlling monomer having a polyolefin uniformly dispersed in said polymer.

14. The carrier of claim 13, wherein said monomer is a radical polymerizable monomer having a polar group in the monomer.

15. The carrier of claim 13, wherein said monomer is a member selected from the group consisting of styrenes, vinyl ethers α-methylene aliphitic monocarboxylic acid esters, vinyl ethers, vinyl ketones, and compounds having fluorine in the side chains thereof.

16. The carrier of claim 13, wherein said polyolefin is a member selected from the group consisting of polyethylene, polypropylene, polybutene, and polyisobutylene.

* * * * *